US006367628B2

(12) United States Patent
Hu

(10) Patent No.: US 6,367,628 B2
(45) Date of Patent: Apr. 9, 2002

(54) TOOL HOLDER DEVICE FOR HEXAGONAL WRENCHES

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/747,132

(22) Filed: Dec. 21, 2000

(30) Foreign Application Priority Data

Jan. 31, 2000 (TW) ..... 89202016 U

(51) Int. Cl.[7] ..... B65D 85/28
(52) U.S. Cl. ..... 206/377; 206/372; 211/70.6
(58) Field of Search ..... 206/349, 372–379; 211/70.6, 69

(56) References Cited

U.S. PATENT DOCUMENTS 2,509,507 A * 5/1950 Kane ..... 206/377
5,535,881 A * 7/1996 Krivec ..... 206/377
5,938,028 A * 8/1999 Hu ..... 206/377
6,112,897 A * 9/2000 Hu ..... 206/377

* cited by examiner

*Primary Examiner*—Luan K. Bui
(74) *Attorney, Agent, or Firm*—Alan Kamrath; Rider, Bennett, Egan & Arundel, LLP

(57) ABSTRACT

A tool holder device comprises a main board, a slide seat releasably engaged with the main board and including a plurality of pegs, and a tool holder including a plurality of receptacles with different diameters for releasably holding wrenches of various sizes. The tool holder is releasably engaged with the slide seat. Each receptacle includes a resilient holding member for releasably holding an associated wrench in place. When the tool holder is engaged with the slide seat, each peg of the slide seat is received in an associated receptacle of the tool holder, and a wrench received in the tool holder rests on an associated peg with the wrench being not held by an associated holding means, thereby allowing ready removal of the wrench from the tool holder.

12 Claims, 9 Drawing Sheets

TOOL HOLDER DEVICE FOR HEXAGONAL WRENCHES

BACKGROUND OF THE INVENTION

1. Field of the Invention

The present invention relates to a tool holder device, and more particularly to a tool holder device that allows easy and ready removal of hexagonal wrenches (i.e., Allen wrenches).

2. Description of the Related Art

Allen wrenches are widely used in daily life, and tool holders therefor are used. A typical Allen wrench holder, as shown in FIGS. 1 and 2 of Taiwan Utility Model Publication No. 311514, generally comprises a number of receiving holes each having a flange formed on an inner periphery thereof for holding a relatively longer section of an Allen wrench. However, the flange is apt to be worn out after a term of usage and thus loses its holding function. In addition, removal of an Allen wrench held in the, e.g., fifth receiving hole requires previous 90° rotation of four Allen wrenches held in the preceding four receiving holes. Furthermore, the holder is usually made of plastic and thus might shrink during manufacture, which may affect the dimension of the flange. As a result, the Allen wrench may not be reliably held in place, as itself has a certain tolerance. FIGS. 3 and 4 of Taiwan Utility Model Publication No. 311514 illustrate another conventional Allen wrench holder which comprises a number of receiving holes each for holding the relatively longer section of an Allen wrench. Although retaining ribs are provided, the retaining effect is poor such that the Allen wrench is apt to disengage from the retaining ribs and thus declines. As a result, the Allen wrench may completely disengage from the holder. In order to solve this problem, Taiwan Utility Model Publication No. 311514 discloses an Allen wrench holder that includes two retaining points for each Allen wrench to be held, one for retaining the relatively longer section of the Allen wrench, while the other for retaining the relatively shorter section of the Allen wrench. Yet, the Allen wrench will sway if it only engages with one of the retaining points. In addition, the user must align the Allen wrench with the retaining points and then apply a force to insert the Allen wrench into the receiving compartment so as to hold the Allen wrench by the two retaining points. However, such operation requires both hands. Taiwan Utility Model Publication No. 295896 discloses an Allen wrench holder that has receiving compartments defined in both sides thereof for receiving Allen wrenches. Namely, it is merely a duplicate of the structure of Taiwan Utility Model Publication No. 311514 and thus has the same disadvantage. In addition, there is a long and unfulfilled need in a tool holder that may hold hexagonal wrenches in an upright manner and allow ready removal of the Allen wrenches for easy use.

SUMMARY OF THE INVENTION

It is the primary object of the present invention to provide an improved tool holder device that includes a tool holder for holding hexagonal wrenches in an upright manner and allowing ready removal of the Allen wrenches for easy use.

In accordance with a first aspect of the invention, a tool holder device comprises a main board, a slide seat releasably engaged with the main board and including a plurality of pegs, and a tool holder including a plurality of receptacles with different diameters for releasably holding wrenches of various sizes. The tool holder is releasably engaged with the slide seat. Each receptacle includes means for releasably holding an associated wrench in place. When the tool holder is engaged with the slide seat, each peg of the slide seat is received in an associated receptacle of the tool holder, and a wrench received in the tool holder rests on an associated peg with the wrench being not held by an associated holding means, thereby allowing ready removal of the wrench from the tool holder.

In accordance with a second aspect of the invention, a tool holder device comprises a main board having a plurality of pegs thereon, and a tool holder releasably engaged with the main board. The tool holder includes a plurality of receptacles with different diameters for releasably holding wrenches of various sizes. Each receptacle includes means for releasably holding an associated wrench in place. When the tool holder is engaged with the main board, each peg of the main board is received in an associated receptacle of the tool holder, and a wrench received in the tool holder rests on an associated peg with the wrench being not held by an associated holding means, thereby allowing ready removal of the wrench from the tool holder.

In accordance with a third aspect of the invention, a tool holder device comprises a main board and a seat including a plurality of pegs having holes of different diameters for holding wrenches of various sizes.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
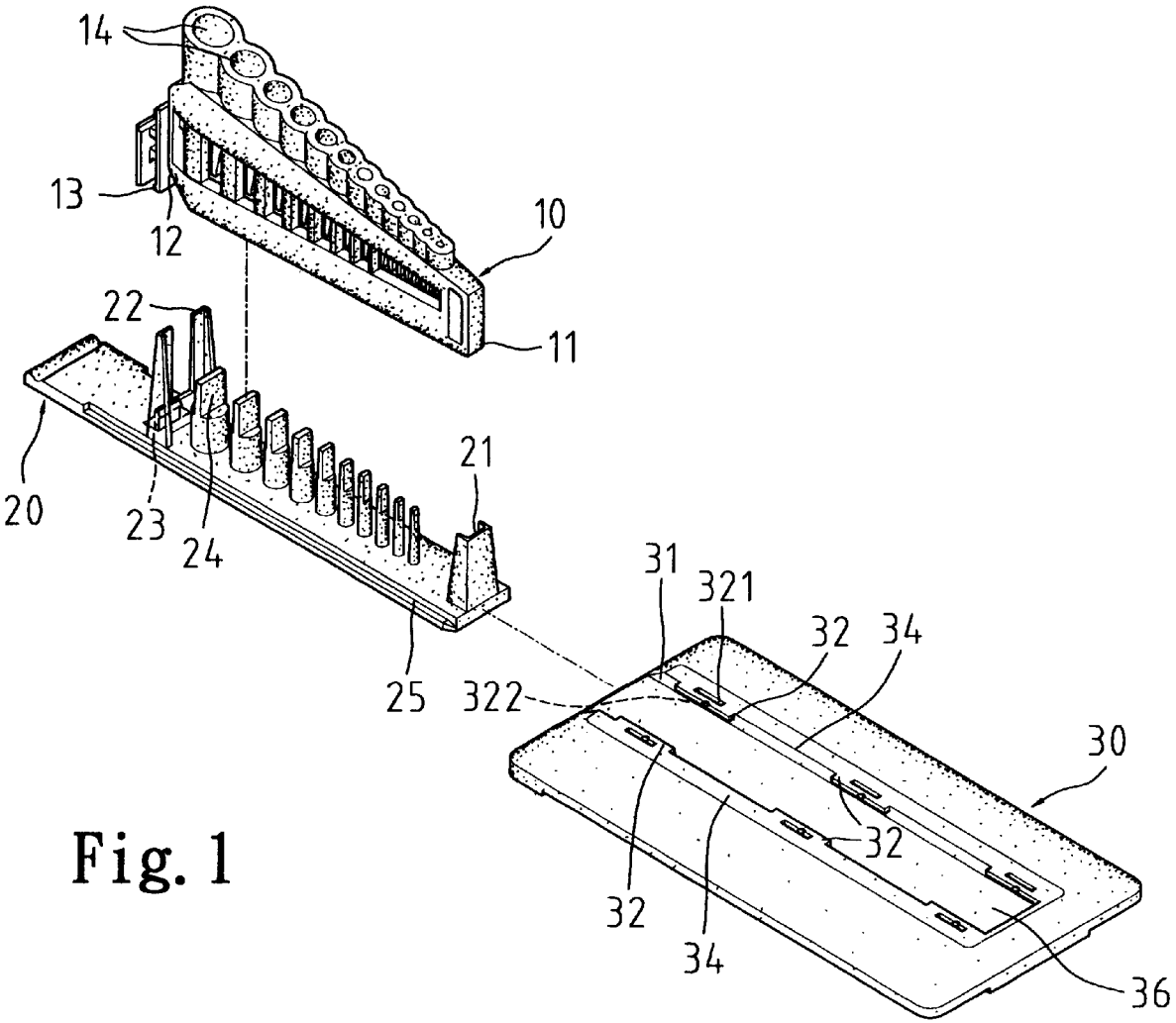
FIG. 1 is an exploded perspective view of a first embodiment of a tool holder device in accordance with the present invention.
Figure 2:
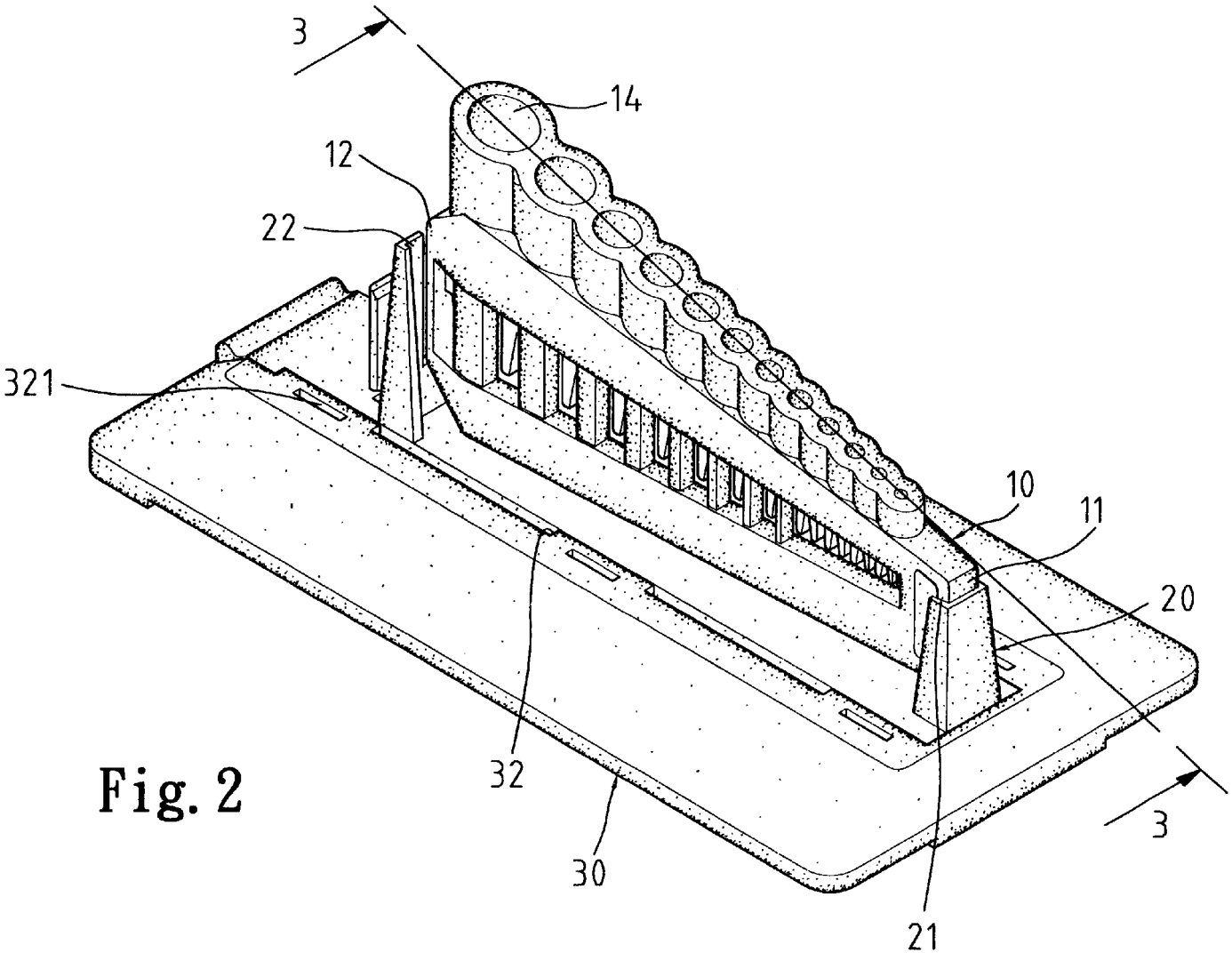
FIG. 2 is a perspective view of the tool holder device in FIG. 1.
Figure 3:
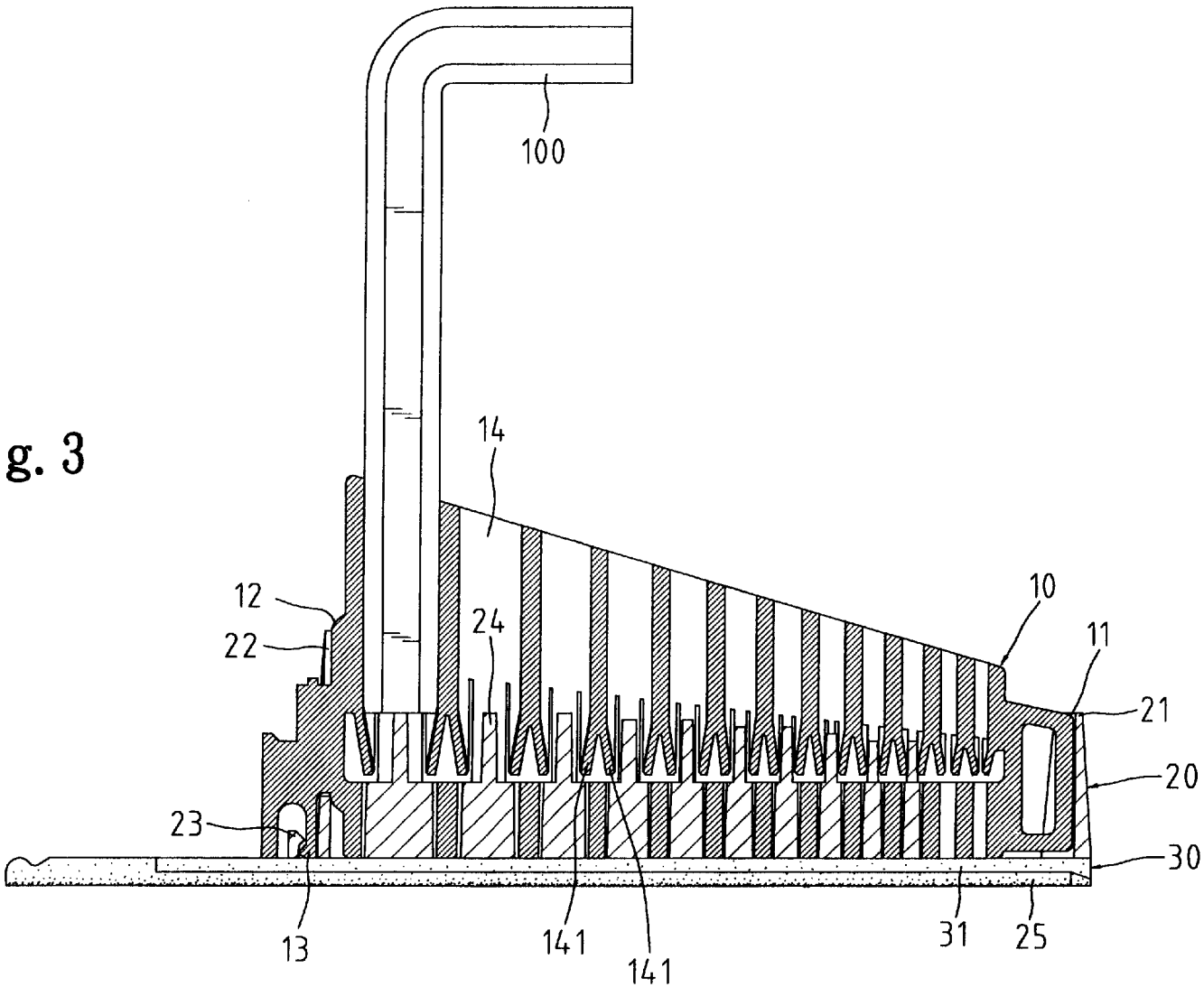
FIG. 3 is a sectional view taken along line 3—3 in FIG. 2.

Referring to the drawings and initially to FIGS. 1 through 3, a tool holder in accordance with the present invention generally includes a tool holder 10, a slide seat 20, and a main board 30. The tool holder 10 includes a first side 11 and a second side 12 with an engaging member 13 formed thereon. A plurality of receptacles 14 is defined between the first side 10 and the second side 12. The receptacles 14 have different diameters for receiving wrenches (e.g., Allen wrenches) of various sizes. A wall defining a portion of each receptacle 14 includes a resilient holding element 141 (FIG. 3) that extends into the respective receptacle 14, which will be described later.

The slide seat 20 includes a first guide groove 21 and a second guide groove 21 for sliding engagement with the first side 11 and the second side 12 of the tool holder 10, respectively. The slide seat 20 further includes an engaging member 23 for releasably engaging with the engaging member 13 of the tool holder 10 to thereby retain the tool holder 10 in place. The slide seat 20 further includes a plurality of pegs 24 on which the Allen wrenches 100 (FIG. 3) rest. The slide seat 20 further includes two lateral wings 25, which will be described later.

The main board 30 includes two lateral guide grooves 31 for sliding engagement with the lateral wings 25 of the slide seat 20. In this embodiment, the main board 30 includes a longitudinal slot 36 with an open side for releasable engagement with the main board 30. Each of two lateral sides 34 defining the longitudinal slot 36 includes a plurality of resilient pieces 32 extending into the longitudinal slot 36. Each resilient piece 32 includes a slot 321 to provide increased resiliency. In addition, each resilient piece 32 includes a protrusion 322 that is in friction contact with an associated lateral wing 25 of the slide seat 20 yet allows sliding movement of the lateral wing 25 in the lateral guide groove 31.

In assembly, the first side 11 and the second side 12 of the tool holder 10 are engaged with and slid along the guide grooves 21 and 22 of the slide seat 20 and the engaging member 13 of the tool holder 10 is engaged with the engaging member 23 of the slide seat 20. The tool holder 10 is thus secured on the slide seat 20 with each peg 24 of the slide seat 20 received in an associated receptacle 14 of the tool holder 10. Next, the lateral wings 25 of the slide seat 20 are engaged with and slid along the lateral guide grooves 31 of the main board 30. It is noted that the protrusion 322 on each resilient piece 32 is in friction contact with an associated lateral wing 25 of the slide seat 20 yet allows sliding movement of the lateral wing 25 in the lateral guide groove 31. The slot 321 in each resilient piece 32 allows slight upward movement when the protrusion 322 is in contact with the associated lateral wing 25. The slide seat 20 is retained in the lateral guide grooves 31 of the main board 30 unless the user applies a relatively larger longitudinal force to overcome the friction between the protrusions 322 and the lateral wings 25 to thereby pull the slide seat 20 away from the main board 30.

As illustrated in FIG. 3, after assembly, the user may directly put an Allen wrench 100 in an associated receptacle 14 with a relatively longer side (not labeled) of the Allen wrench 100 inserting into the associated receptacle 14 and with an end face of the relatively longer side resting on a top of the associated peg 24. It is noted that the Allen wrench 100 is not "clamped" or held by the resilient holding member 141 of the tool holder 10. This allows the user to readily remove the Allen wrench 100 for use. In addition, the Allen wrench 100 is elevated by an associated peg 24 and stands in an upright manner which further facilitates easy and ready removal of the Allen wrench 100.

Figure 4:
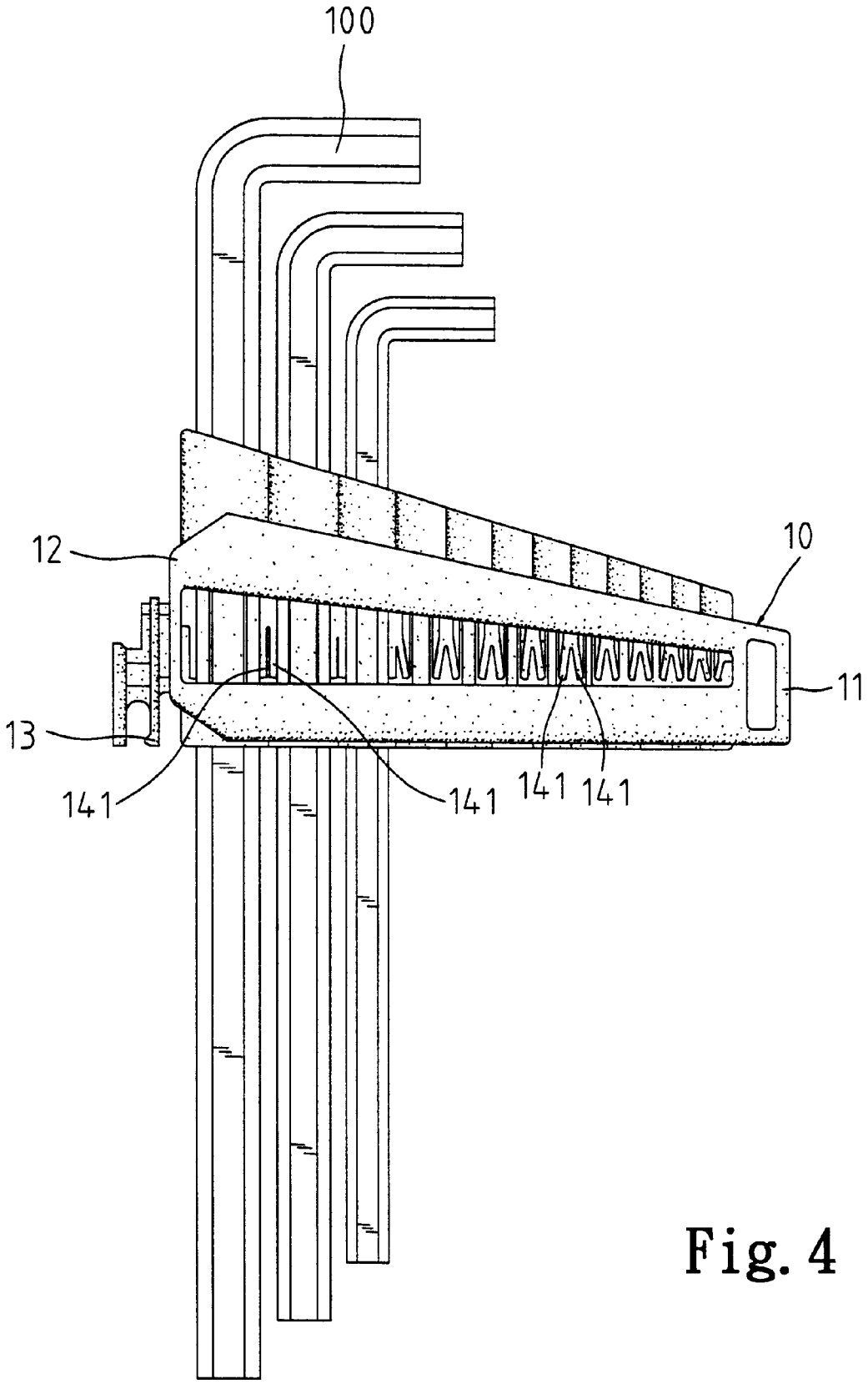
FIG. 4 is a side view illustrating use of a tool holder of the tool holder device in FIG. 1.

The tool holder 10 may be disengaged from the slide seat 20 for separate use. In this case, the relatively longer sections of the Allen wrenches 100 may be inserted into associated receptacles 14 and held in place by associated resilient holding members 141 projected from the walls defining the receptacles 14, best shown in FIG. 4. Removal of the Allen wrench 100 can be achieved by pulling the respective Allen wrench 100 from the respective receptacle 14.

Figure 5:
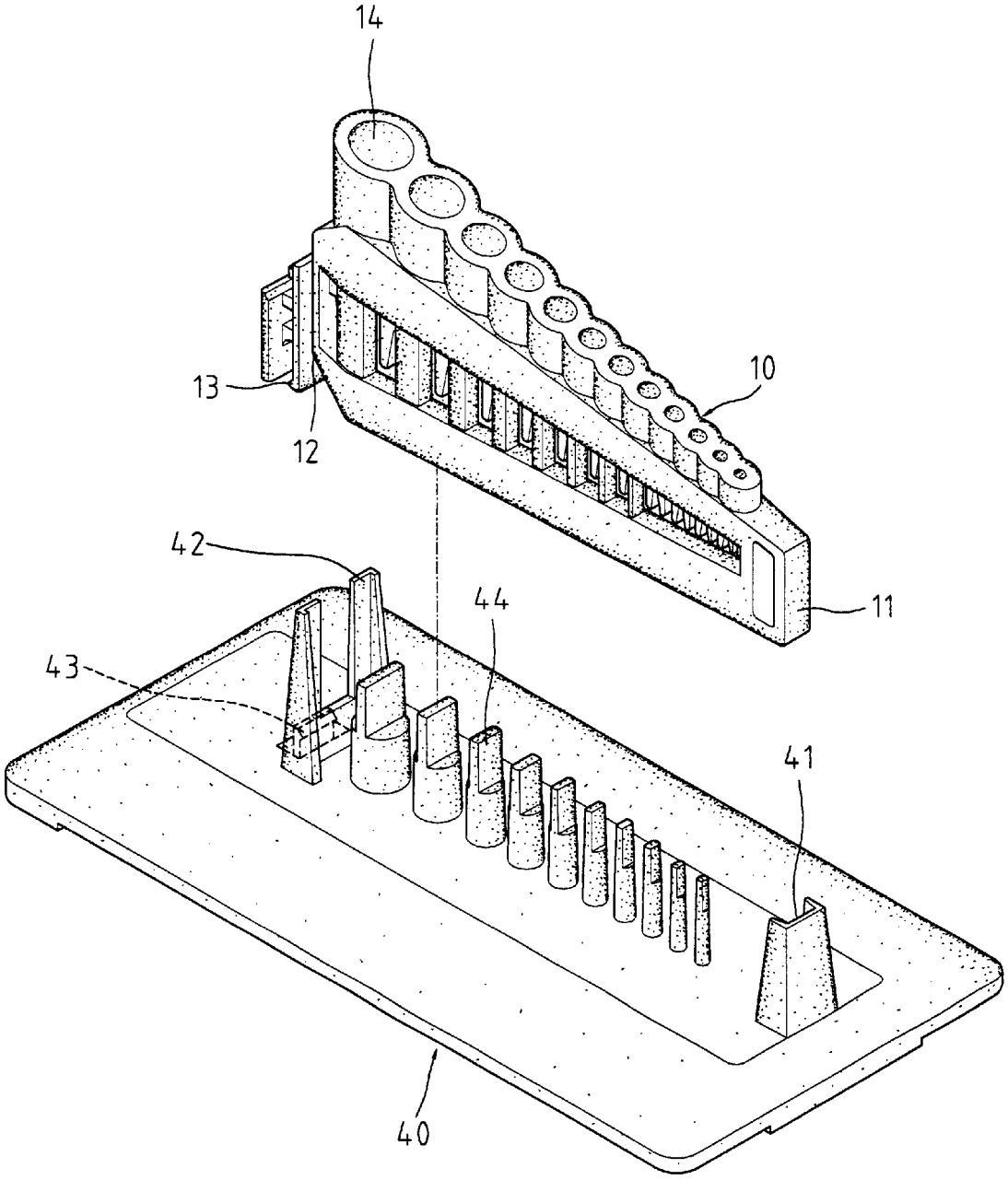
FIG. 5 is an exploded perspective view of a second embodiment of the tool holder device in accordance with the present invention.
Figure 6:
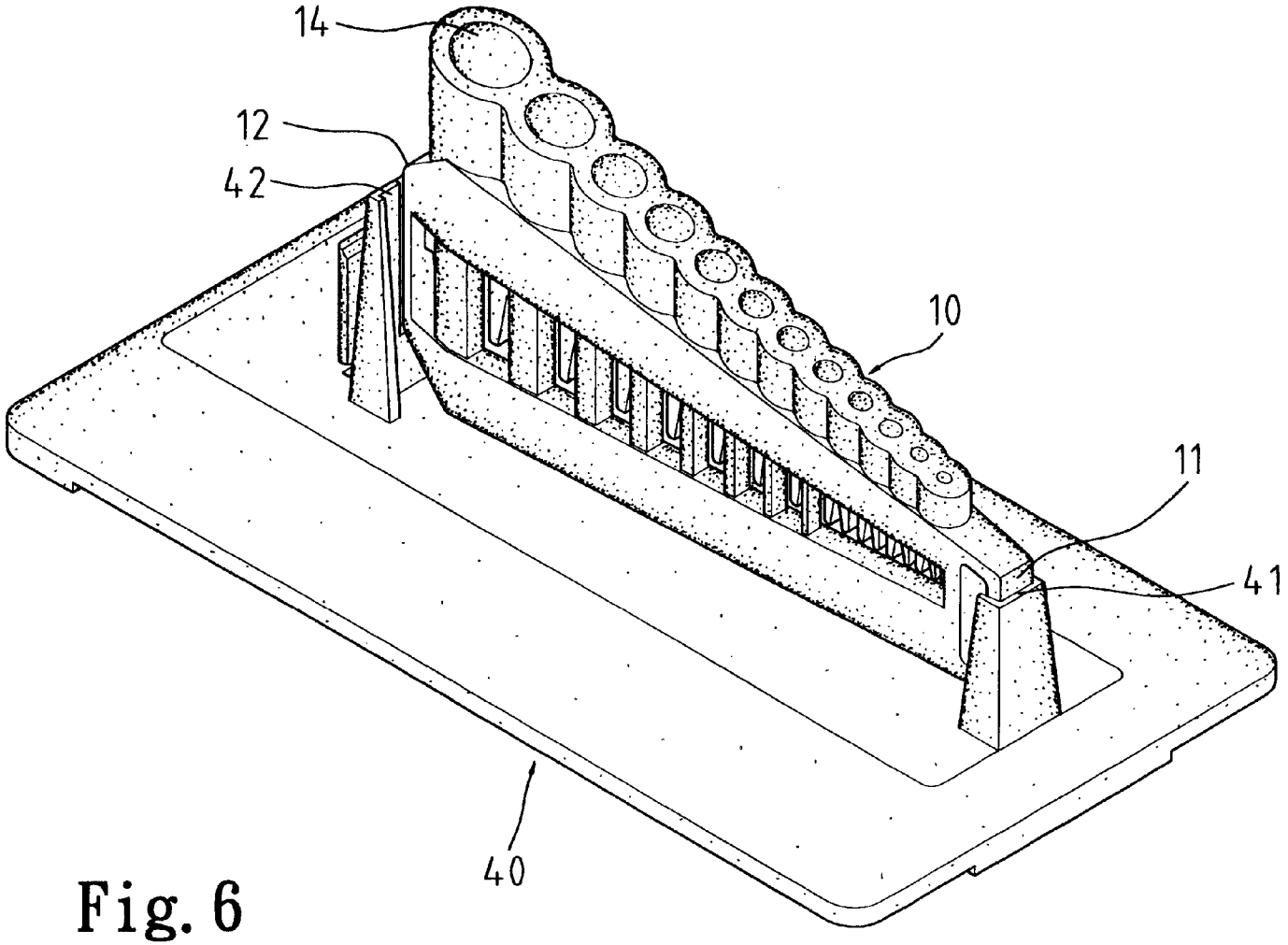
FIG. 6 is a perspective view of the tool holder device in FIG. 5.

FIGS. 5 and 6 illustrate a modified embodiment of the tool holder device, wherein the main board and the slide seat in the first embodiment are integrally formed. More particularly, in this embodiment, the tool holder device includes a tool holder 10 and a main board 40. The tool holder 10 includes a first side 11 and a second side 12 with an engaging member 13 formed thereon. A plurality of receptacles 14 is defined between the first side 10 and the second side 12. The receptacles 14 have different diameters for receiving wrenches (e.g., Allen wrenches) of various sizes. A wall defining a portion of each receptacle 14 includes a resilient holding element (not shown) that extends into the respective receptacle 14 for holding an associated Allen wrench in place. The main board 40 includes a first guide groove 41 and a second guide groove 42 for sliding engagement with the first side 11 and the second side 12 of the tool holder 10, respectively. The main board 40 further includes an engaging member 43 for releasably engaging with the engaging member 13 of the tool holder 10 to thereby retain the tool holder in place 10. The main board 40 further includes a plurality of pegs 44 on which the Allen wrenches rest.

After assembly, the user may directly put an Allen wrench in an associated receptacle 14 with a relatively longer side of the Allen wrench inserting into the associated receptacle 14 and with an end face of the relatively longer side resting on a top of the associated peg 24. It is noted that the Allen wrench is not "clamped" or held by the resilient holding member 141 of the tool holder 10. This allows the user to readily remove the Allen wrench for use. In addition, the Allen wrench is elevated by an associated peg 24 and stands in an upright manner which further facilitates easy and ready removal of the Allen wrench.

The tool holder 10 may be disengaged from the main board 40 for separate use. In this case, the relatively longer sections of the Allen wrenches may be inserted into associated receptacles 14 and held in place by associated resilient holding members projected from the walls defining the receptacles. Removal of the Allen wrench can be achieved by pulling the respective Allen wrench from the respective receptacle 14.

Figure 7:
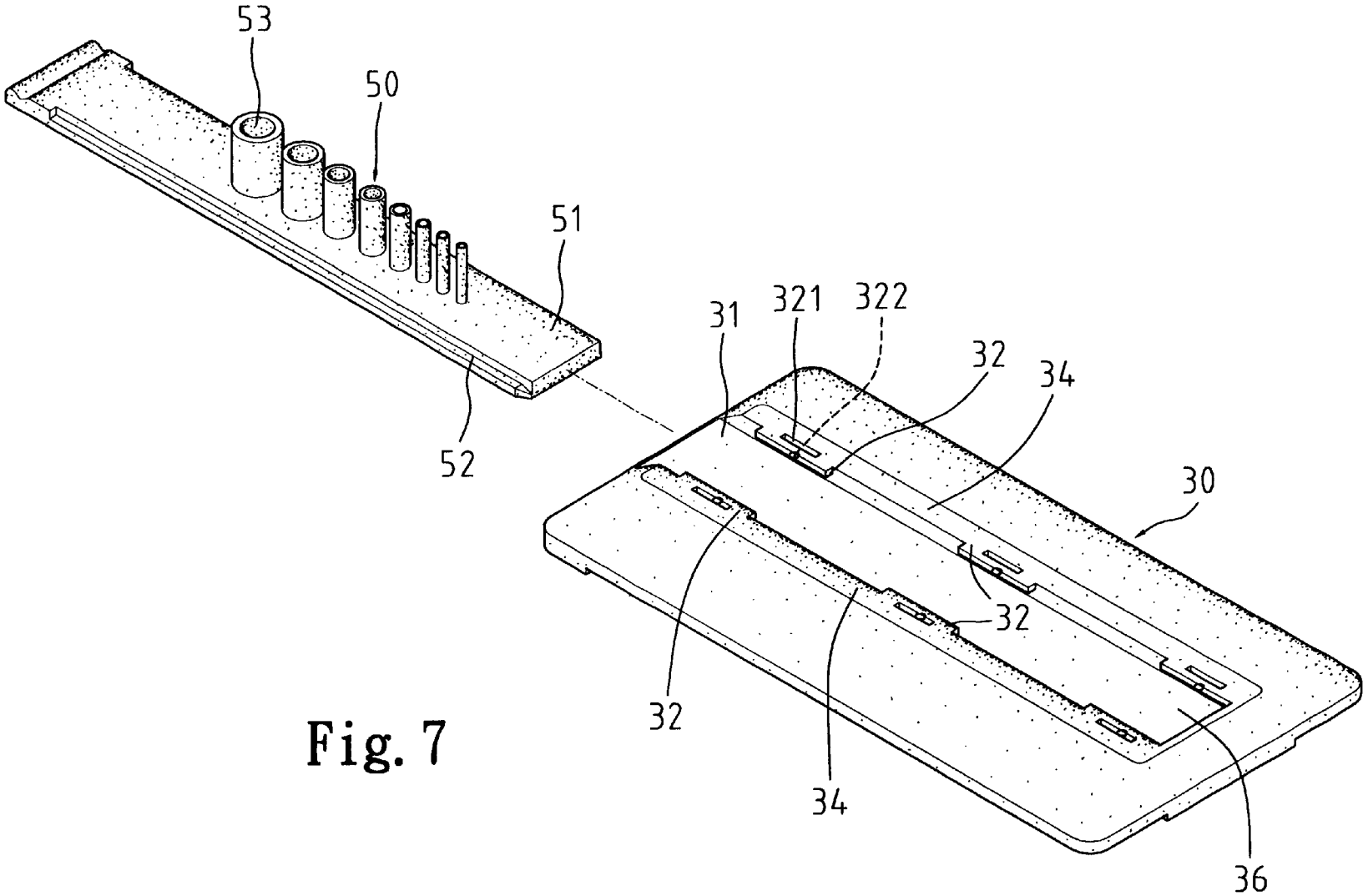
FIG. 7 is an exploded perspective view of a third embodiment of the tool holder device in accordance with the present invention.
Figure 8:
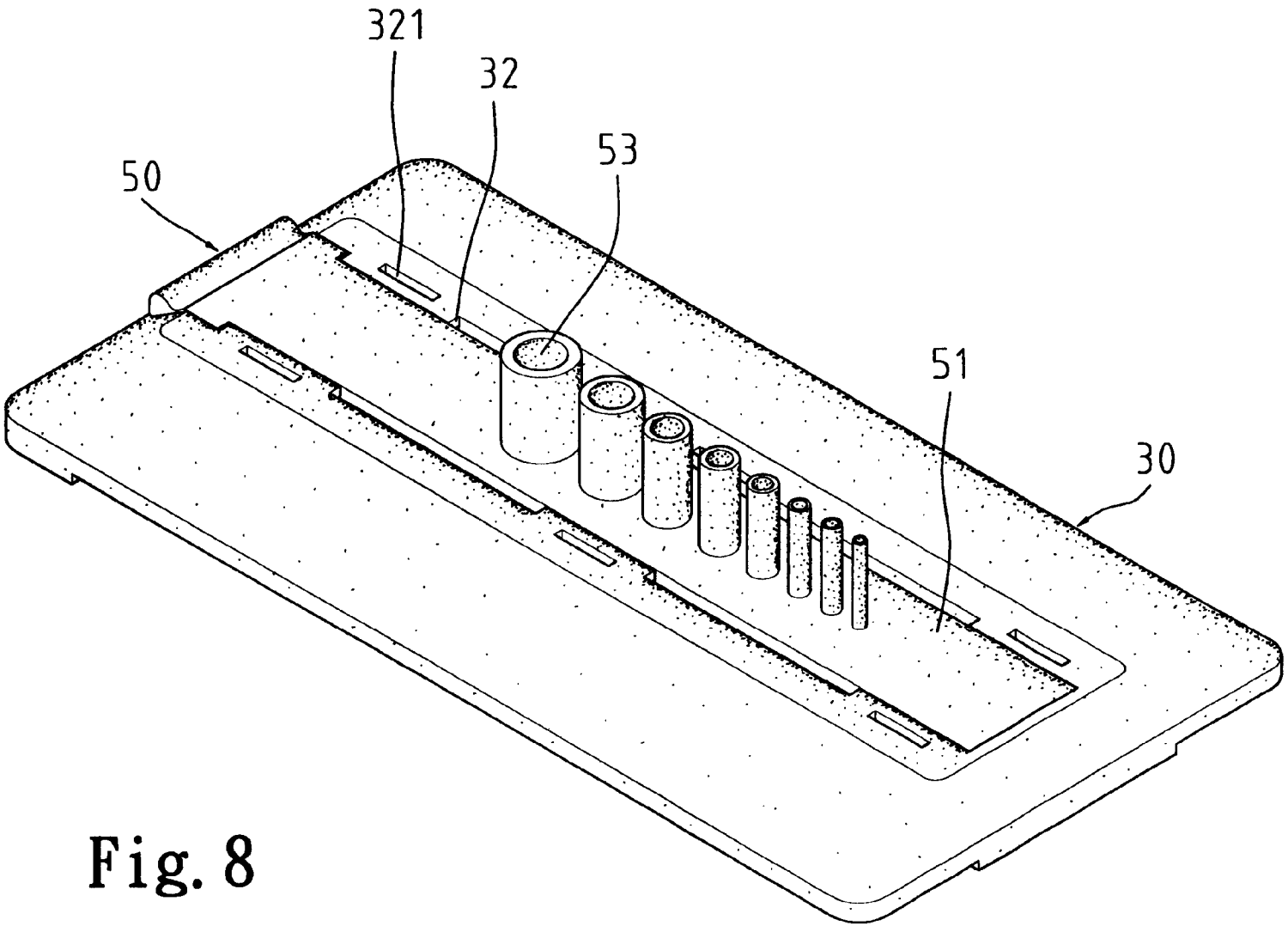
FIG. 8 is a perspective view of the tool holder device in FIG. 7.
Figure 9:
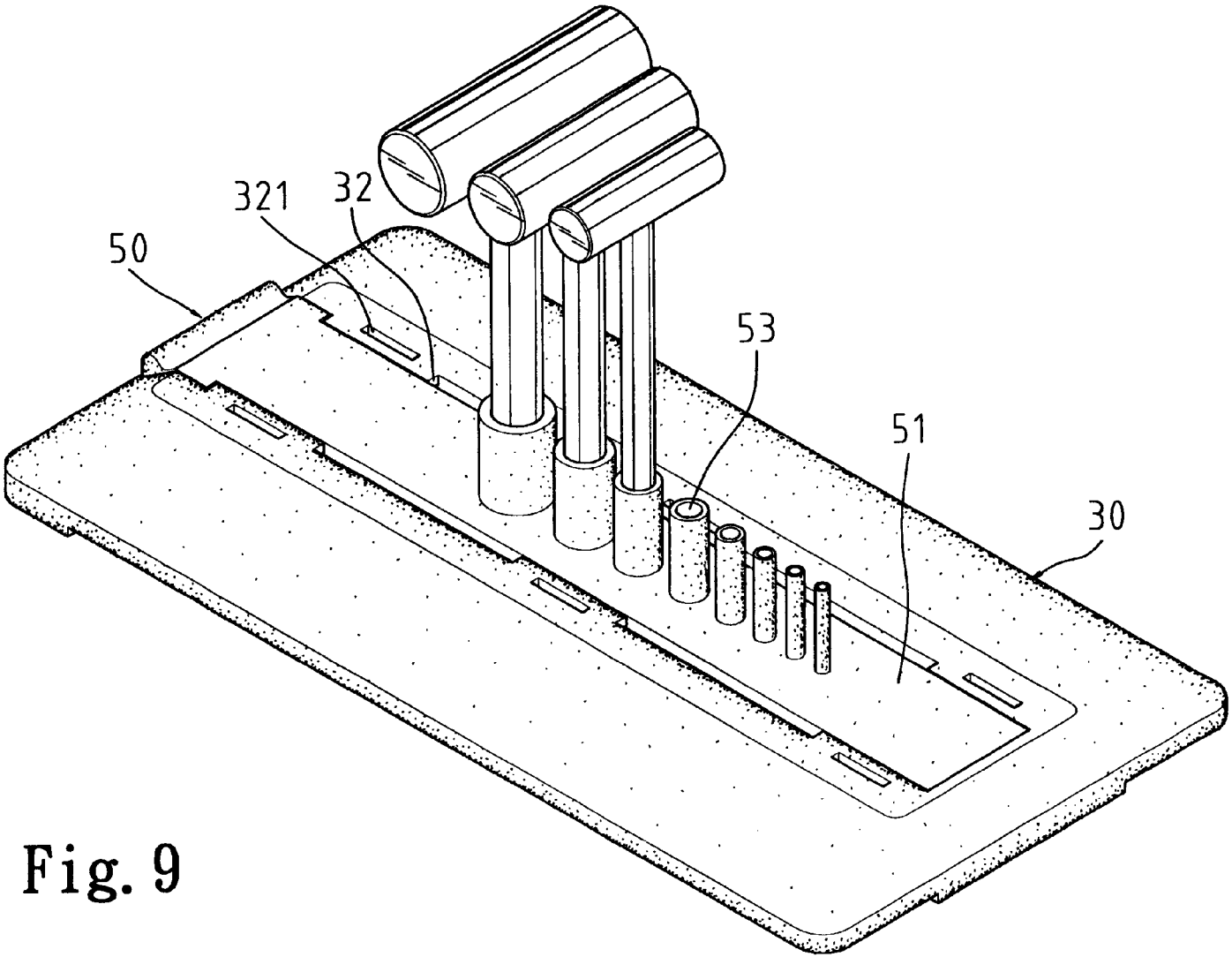
FIG. 9 is a perspective view illustrating use of the tool holder device in FIG. 8.

FIGS. 7 and 8 illustrate a further modified embodiment of the invention. In this embodiment, the tool holder device includes a main board 30 and a seat 50. The main board 30 includes two lateral guide grooves 31 for sliding engagement with two lateral wings 52 of the seat 50. The main board 30 includes a longitudinal slot 36 with an open side (not labeled) for releasable engagement with the main board 30. Each of two lateral sides 34 defining the longitudinal slot 36 includes a plurality of resilient pieces 32 extending into the longitudinal slot 36. Each resilient piece 32 includes a slot 321 to provide increased resiliency. In addition, each resilient piece 32 includes a protrusion 322 that is in friction contact with an associated lateral wing 52 of the slide seat 50 yet allows sliding movement of the lateral wing 52 in the lateral guide groove 31. The slide seat 50 includes a plurality of pegs 53 having holes (not labeled) of different diameters for holding T-shape Allen wrenches 110 (FIG. 9) of various sizes.

According to the above description, it is appreciated that the tool holder device in accordance with the present invention allows easy and ready removal of Allen wrenches that are supported in an upright manner. The Allen wrenches are elevated to facilitate removal. It is noted that the tool holder is not limited to the illustrated holding member 141 for holding Allen wrenches in place; namely, other types of holding member can be used to achieve the purpose of holding Allen wrenches in place.

Although the invention has been explained in relation to its preferred embodiment, it is to be understood that many other possible modifications and variations can be made without departing from the spirit and scope of the invention as hereinafter claimed.

What is claimed is:

1. A tool holder device comprising:

a main board;

a slide seat releasably engaged with the main board and including a plurality of pegs; and a tool holder including a plurality of receptacles with different diameters for releasably holding wrenches of various sizes, the tool holder being releasably engaged with the slide seat, each said receptacle including means for releasably holding an associated wrench in place;

wherein when the tool holder is engaged with the slide seat, each said peg of the slide seat is received in an associated said receptacle of the tool holder, and a wrench received in the tool holder rests on an associated said peg, thereby allowing ready removal of the wrench from the tool holder.

2. The tool holder device as claimed in claim 1, wherein the tool holder includes a first side and a second side, the slide seat including a first guide groove and a second guide groove for sliding engagement with the first side and the second side of the tool holder, respectively.

3. The tool holder device as claimed in claim 2, wherein the tool holder includes a first engaging member and the slide seat includes a second engaging member for releasably engaging with the first engaging member.

4. The tool holder device as claimed in claim 1, wherein the slide seat includes two lateral wings and the main board includes two lateral guide grooves for sliding engagement with the lateral wings of the slide seat, respectively.

5. The tool holder device as claimed in claim 4, wherein each of two lateral sides defining the longitudinal slot includes at least one resilient piece extending into the longitudinal slot, said at least one resilient piece including a slot to provide increased resiliency.

6. The tool holder device as claimed in claim 5, wherein said at least one resilient piece includes a protrusion that is in friction contact with an associated said lateral wing of the slide seat yet allows sliding movement of the associated lateral wing in the lateral guide groove.

7. The tool holder device as claimed in claim 1, wherein the wrench is an Allen wrench.

8. A tool holder device comprising:

a main board having a plurality of pegs thereon; and a tool holder releasably engaged with the main board, the tool holder including a plurality of receptacles with different diameters for releasably holding wrenches of various sizes, each said receptacle including means for releasably holding an associated wrench in place;

wherein when the tool holder is engaged with the main board, each said peg of the main board is received in an associated said receptacle of the tool holder, and a wrench received in the tool holder rests on an associated said peg, thereby allowing ready removal of the wrench from the tool holder.

9. The tool holder device as claimed in claim 8, wherein the tool holder includes a first side and a second side, the main board including a first guide groove and a second guide groove for sliding engagement with the first side and the second side of the tool holder, respectively.

10. The tool holder device as claimed in claim 9, wherein the tool holder includes a first engaging member and the main board includes a second engaging member for releasably engaging with the first engaging member.

11. The tool holder device as claimed in claim 8, wherein the wrench is an Allen wrench.

12. The tool holder device as claimed in claim 8, further comprising:

a slide seat releasably engaged with the main board and including the plurality of pegs, with the tool holder being releasably engaged with the slide seat releasably engaged with the main board.

* * * * *